United States Patent [19]

Castaldo

[11] Patent Number: 4,755,223

[45] Date of Patent: Jul. 5, 1988

[54] LIQUID COMPOSITION FOR CLEANING AND POLISHING CYMBALS COMPRISING KAOLIN CLAY

[76] Inventor: Antonio Castaldo, 1170 Klockner Rd., Trenton, N.J. 08619

[21] Appl. No.: 86,939

[22] Filed: Aug. 17, 1987

Related U.S. Application Data

[63] Continuation-in-part of Ser. No. 899,202, Aug. 22, 1986, Pat. No. 4,687,591.

[51] Int. Cl.[4] ..... C11D 1/24; C11D 3/14

[52] U.S. Cl. ..... 106/3; 252/90; 252/89.1; 252/174.25; 252/549; 252/558; 252/DIG. 14; 252/173

[58] Field of Search ..... 252/90, 89.1, 174.25, 252/549, 558, DIG. 14; 106/3

[56] References Cited

U.S. PATENT DOCUMENTS

| | | | |
|---|---|---|---|
| 2,672,449 | 3/1954 | Snell et al. | 252/100 |
| 2,716,610 | 8/1955 | Russo et al. | 106/3 |
| 2,739,129 | 3/1956 | Manchot | 252/174.25 |
| 2,868,732 | 1/1959 | Truc | 252/136 |
| 3,248,235 | 4/1966 | Pryor et al. | 106/3 |
| 3,294,726 | 12/1966 | Wyner | 252/174.25 |
| 3,330,672 | 7/1967 | Warwick et al. | 106/3 |
| 3,899,437 | 8/1975 | Regan et al. | 252/106 |
| 4,532,066 | 7/1985 | Paszek et al. | 252/144 |
| 4,587,032 | 5/1986 | Rogers | 252/174.17 |

FOREIGN PATENT DOCUMENTS

| | | |
|---|---|---|
| 100197 | 6/1982 | Japan . |
| 6794 | 1/1985 | Japan . |
| 763394 | 12/1956 | United Kingdom . |
| 243760 | 4/1966 | U.S.S.R. . |

*Primary Examiner*—Prince E. Willis

*Attorney, Agent, or Firm*—Norman B. Rainer

[57] ABSTRACT

A specially formulated composition is provided for the cleaning and polishing of cymbals. The formulation, which is an aqueous suspension, can be applied by squeeze bottle. The composition not only removes dirt and provides a glossy shine, but retards subsequent tarnishing of the brass cymbal. The active ingredients of the composition include kaolin clay, Hydrochloric acid, its sodium salt, an anionic surfactant, and water.

2 Claims, No Drawings

LIQUID COMPOSITION FOR CLEANING AND POLISHING CYMBALS COMPRISING KAOLIN CLAY

RELATED APPLICATIONS

This application is a continuation-in-part of U.S. patent application Ser. No. 899,202, filed on 8/22/86, now U.S. Pat. No. 4,687,591.

BACKGROUND OF THE INVENTION

This invention relates to a composition for cleaning metal surfaces, and more particularly concerns a composition useful in imparting a long-lasting lustrous appearance to cymbals.

Cymbals utilized as musical instruments are generally fabricated of bronze metal. Because of the percussive manner of playing the cymbals, especially when struck by a drum stick, the cymbals accumulate surface indentations which hold dust or surface films comprised of oxides and/or sulfides, generally referred to as tarnish.

The cleaning of the cymbals is therefore more difficult than the cleaning of unblemished metal surfaces. Also, whereas most metal polishes leave a significant deposit of protective agent, such deposits would adversely affect the sound-producing qualities of the cymbals. Because of the thinness of the cymbals and their need to survive repeated potentially deforming stresses, it would be detrimental to use conventional polishes having strong abrasives or chemicals which remove significant amounts of metal or metal oxide from the surface being polished.

It is accordingly an object of this invention to provide a composition for cleaning bronze musical cymbals.

It is further object of this invention to provide a composition pursuant to the foregoing object which will cause the cleaned surfaces of the cymbal to resist subsequent accumulation of dirt and tarnish.

It is a another object of the present invention to provide composition of the aforesaid nature formulated to remove minimal amounts of metal and metal oxide from the surface being cleaned.

It is a still further object of the invention to provide a composition of the aforesaid nature in the form of a water-based liquid which may be dispensed as a stream or spray from a plastic squeeze bottle.

It is yet another object of the present invention to provide a composition of the aforesaid nature which is substantially non-toxic and of low cost.

These objects and other objects and advantages of the invention will be apparent from the following description.

SUMMARY OF THE INVENTION

The above and other beneficial objects and advantages are accomplished in accordance with the present invention by a liquid composition comprised by weight of:

(a) between 15 and 25 percent of a finely divided Kaolin clay, (b) between 4 and 8 percent of a chloride salt of a cation such as sodium or ammonium, (c) between 1 and 3 percent of an anionic surfactant, and (d) the balance being water, said composition having a PH in the range of 6.5 to 7.5.

BRIEF DESCRIPTION OF THE DRAWING

The composition of this invention is preferably made by first dispersing the clay in about one third of the amount of water contained in the final composition. Said dispersing effect is secured by vigorous agitation as may be provided by high speed mixers such as the Waring blender. The remaining ingredients are subsequently added while maintaining a lesser intensity of agitation. The pH of the mixture is adjusted to the requisite value by addition of sodium hydroxide solution of Hydrochloric acid.

In the event that persistent foam may be generated during the preparation and handling of the composition, small quantities of a foam preventing agent may be added, a suitable such agent being Colloid 581-B manufactured by Colloids, Inc. of Newark, N.J.

A preferred kaolin clay is Kaopolite SF, having acidic characteristics and distribution by Kaopolite, Inc. of Union, N.J. Such clays are aluminum silicates, and have particle sizes sufficiently small to remain suspended in water for long periods of time following moderate agitation such as shaking of the composition confined within a container such as a plastic squeeze bottle adapted to dispense the composition.

The water utilized in formulating the composition is preferably deionized as may be produced by treatment with ion exchange resins, or by distillation.

The composition may be prepared by using Hydrochloric acid and neutralizing quantities of sodium hydroxide.

A particularly preferred anionic surfactant is Dowfax 2A0 (Dow Chemical Co., Midland, Mich.) a disulfonated alkyl aryl ether in acid form having wide electrolyte tolerance.

The following example illustrates a preferred embodiment of this invention and is not intended to limit the invention.

EXAMPLE

Twenty grams of Kaopolite SF powder are slowly added to 25 grams of deionized water in a Waring blender while maintaining continuous rapid agitation to produce a smooth, uniform mixture. Under reduced agitation, there is then added: 43 grams of deionized water, 3.5 grams of 50% Sodium Hydroxide, 6 grams of a 20% aqueous solution of Hydrochloric Acid, and 2.0 grams of Dowfax 2A0.

The mixture is agitated until thoroughly homogeneous, and the pH is adjusted to 7.0 by dropwise additions of sodium hydroxide solution or hydrochloric acid solution. Such neutralization of hydrochloric acid with sodium hydroxide generates sodium chloride within the composition. About 0.1 gram of Colloid 581-B is added to the mixture to reduce foaming, and the mixture is loaded into plastic squeeze bottles having a dispensing nozzle and protective lid.

When the composition is applied onto a bronze cymbal, it is found that with mild buffing action, a highly lustrous appearance is produced, and the appearance remains stable for weeks under normal playing conditions and with normal exposure to ambient air. No build-up of the composition is evident on the surface of the cymbal and the sound quality of the cymbal is not adversely affected.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention what is claimed is:

1. A liquid composition for cleaning and polishing cymbals comprised by weight of:

(a) between 15 and 25 percent of a finely divided Kaolin clay, (b) between 4 and 8 percent of sodium chloride, (c) between 1 and 3 percent of a disulfonated alkyl aryl ether surfactant having electrolyte tolerance, (d) a minimum effective quantity of a colloidal foam suppressing substance, and (e) the balance being water, said composition having a pH in the range of 6.5 to 7.5, and being confined within a squeeze bottle equipped with a dispensing nozzle.

2. The composition of claim 1 wherein said kaolin clay has acidic characteristics.

* * * * *